United States Patent [19]

Batham et al.

[11] 4,353,739

[45] Oct. 12, 1982

[54] DESULPHURIZATION OF FERROUS MELTS

[75] Inventors: John K. Batham, Brierley Hill; Alan G. Fox, Birmingham; Evan T. R. Jones, Sutton Coldfield, all of England

[73] Assignee: Foseco International Limited, Birmingham, England

[21] Appl. No.: 261,685

[22] Filed: May 7, 1981

[30] Foreign Application Priority Data

May 10, 1980 [GB] United Kingdom ..... 8015566

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,656,989 | 4/1972 | Layland | 75/58 |
| 4,225,343 | 9/1980 | Guarino | 75/53 |
| 4,266,969 | 5/1981 | Koros | 75/53 |

*Primary Examiner*—P. D. Rosenberg

*Attorney, Agent, or Firm*—Cushman, Darby & Cushman

[57] ABSTRACT

Method of desulphurizing a ferrous melt comprises injecting into the melt lime-containing particles having smooth surfaces, a low tendency to absorb moisture and blocked pores formed by solidification of molten inorganic matter in the pores of the lime. Method of making a desulphurization agent for the desulphurizing method comprises calcining limestone with, for example, sodium carbonate, calcium fluoride or siliceous matter. Desulphurization agents per se are also described.

14 Claims, 1 Drawing Figure

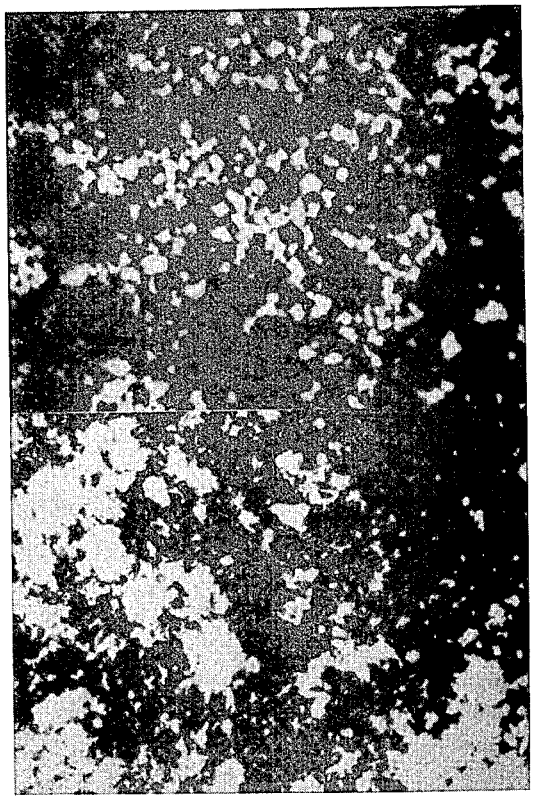

DESULPHURIZATION OF FERROUS MELTS

The invention concerns desulphurisation of ferrous melts, lime-containing desulphurisation agents for such melts and manufacture of such agents.

It is well known to use lime-containing products for the desulphurisation of ferrous melts. Whilst the high basicity of lime (CaO) is an advantage for this purpose, the desulphurisation effect achievable by using lime by itself is poor and this may be attributed to the fact that the very high melting point of lime means that lime does not fuse at typical molten iron or steel temperatures. For this reason, it is usual to employ a flux e.g. calcium fluoride with the lime in order that the desulphurisation agent should fuse at least to some extent, e.g. to form a liquid desulphurising slag, as a result of contact with the ferrous melt. It has been suggested that a lime-containing desulphurisation agent having an improved ability to desulphurise molten pig iron can be made by sintering lime and specified amounts of one or more selected additives e.g. calcium fluoride.

In the past, desulphurisation of ferrous melts in ladles by use of lime-containing desulphurisation agents has usually been effected by adding the desulphurisation agent from bags direct to the ladle and then pouring the ferrous melt into the ladle. The turbulence caused by pouring in the melt causes mixing of the melt and desulphurisation agent but this only lasts for the relatively short duration of the pouring and after pouring has been completed the rate of desulphurisation diminishes greatly. The use of a variety of types of stirrer has been proposed to achieve continuing mixing after the completion of pouring but under the severe conditions of use the stirrers are short-lived.

Injection as a means of adding a lime-containing desulphurisation agent has the advantage of causing continuous mixing but the known desulphurisation agents have usually been unsuitable for injection. The known desulphurisation agents generally have rough surfaces and do not flow freely. This means that such agents would be difficult to inject and, in particular, that unacceptably long injection times would be needed to supply the desired amount of desulphurisation agent.

According to the present invention a method of desulphurising a ferrous melt comprises injecting into the melt a desulphurisation agent comprising lime-containing particles having a low tendency to absorb moisture, having smooth surfaces and having blocked pores formed by the solidification of molten inorganic matter in the pores in the lime.

In the method of the invention, the lime-containing particles used have smooth surfaces and this imparts good free flowing properties to the particles and enables high, controlled injection rates to be used. Preferably the injection rate is at least 30 kg/minute, for example in the range of 40 to 60 kg/minute. The desulphurisation agent can be injected in an inert carrier gas e.g. nitrogen or, preferably argon.

The amount of desulphurisation agent needed per ton of ferrous melt in carrying out the method of the invention depends on the sulphur content of the melt and the level to which the sulphur content is required to be reduced. The amount of desulphurisation agent needed will however generally be 4 to 7 kg/ton for molten iron and 2–4 kg/ton for molten steel. Typically the final sulphur content will be not more than 30% of the initial sulphur content, e.g. an initial content of 0.015% may be reduced to 0.003% and an initial content of 0.02% may be reduced to 0.005.

Lime for lime-containing desulphurisation agents for ferrous melts is made by calcining particulate limestone, i.e. heating mineral calcium carbonate to convert it to lime, and the calcination produces little change in the particle size although there is a weight loss of about 40%. Consequently, the lime is very porous and has rough surfaces. However, in accordance with the invention it has been found that lime particles with smooth surfaces can be made if, during or after the calcination, pores in the lime are blocked by solidification of molten inorganic matter in the pores.

The blocking of the pores is preferably effected by calcining limestone with added inorganic matter that softens or fuses, partly or completely, at the calcination temperature or that combines with the lime to form a compound that softens or fuses, partly or completely, at the calcination temperature. Limestone for metallurgical purposes is commonly calcined at a temperature of about 1000° C. but the temperature used in the invention may be higher depending on the temperature needed to form the molten inorganic matter that subsequently solidifies in the pores in the lime.

Instead of calcining limestone with the added inorganic matter, lime itself may be heated with the inorganic matter to cause the softening or fusion but this procedure involves two heating steps as the lime must first be made by calcining limestone.

It has been found in accordance with the invention that a variety of inorganic materials are suitable for producing the pore-blocking effect. Examples are sodium carbonate, silica, calcium fluoride and naturally occurring or man-made silicates or other siliceous materials e.g. basalt, olivine, perlite, wollastonite, grog, high alumina firebrick, cement clinker, dicalcium silicate and tricalcium silicate.

Because of its relatively low melting point, sodium carbonate has the advantage that it will give the pore-blocking effect even at relatively low calcination temperatures e.g. 1000° C. As little as 1%, e.g. 1.5% by weight of sodium carbonate based on the total of lime and sodium carbonate is sufficient to produce the pore-blocking effect. Sodium carbonate has the further advantage of being a desulphurisation agent in its own right for ferrous melts. The use of sodium carbonate is especially preferred if the desulphurisation agent is to be injected into molten iron. When sodium carbonate is used it preferably forms 1 to 20% by weight of the desulphurisation agents. In the case of steel melts, typically with substantially higher temperatures than iron melts, it is preferred to use little or no sodium carbonate as high proportions e.g. more than 5% by weight, of this material can give rise to fume problems.

Silica is known to behave as a flux with lime but its presence in lime-containing desulphurisation agents has generally been avoided or minimised because its acidity diminishes the basicity provided by the highly basic lime. Significantly, a typical specification for lime for metallurgical purposes requires that the amount of any silica present should be less than 1%. However, in accordance with the invention it has been found that silica and siliceous materials are very effective for causing blocking pores in the lime and that such small amounts are effective for this purpose that the benefits obtained far outweigh any consequent diminution in basicity.

If silica or a siliceous material is used to achieve the pore-blocking effect, preferably at least 1.6 parts by weight of silica or siliceous material are employed per 100 parts by weight of the lime. Preferably not more than 5, e.g. 3, parts by weight of silica or siliceous material are used per 100 parts by weight of the lime. Higher proportions tend to decrease the basicity of the material further without giving a compensating further improvement in desirable properties arising from the pore-blocking. If the amount used is less than 1.6 parts by weight per 100 parts by weight of the lime, the desirable effects arising from the pore-blocking arise only to a slight extent.

Certain types of limestone contain silica in amounts such that lime obtained by calcining the limestone has a significant content e.g. 3% by weight of silica and such lime has been regarded as unsuitable for metallurgical purposes. However, such lime can be used in the invention as long as the limestone from which the lime is derived is calcined at a sufficiently high temperature e.g. 1200° C. or more to cause the silica to give rise to the pore-blocking effect. Likewise, where added silica is used to cause the pore-blocking effect, the limestone (or lime) and added silica should be heated at a temperature of it least 1200° C. As the silica content of limestones containing a significant proportion of silica tends to be rather variable, it is preferred to use, where silica is desired, a low silica content limestone or lime and to add silica in an amount to give the desired proportion rather than to rely only on the presence of silica initially present in the limestone or lime.

In the case of siliceous additives other than silica itself the pore-blocking effect may be achieved at temperatures below 1200° C. but in any event the temperature must be high enough to calcine the limestone, assuming that the additive is initially mixed with limestone rather than lime.

If the pore-blocking effect is to be achieved by use of calcium fluoride, it is preferred to achieve this by calcining a mixture of limestone and calcium fluoride at a temperature of at least 1200° C. Where calcium fluoride is employed, it preferably forms 1 to 30% by weight of the desulphurisation agent.

The fact that the pore-blocking effect leads to particles having smooth surfaces and hence to good free flowing properties and thus to suitability for injection has been described above but this is not the only advantage yielded by the blocking of the pores. As already noted, lime made by calcination of limestone is very porous and this leads to such lime having a very marked tendency to absorb moisture. This tendency can be diminished to some extent by calcining the limestone at higher temperatures than usual e.g. 1200° C. rather than 1000° C. but the lime still has a marked tendency to absorb water. The presence of moisture in a desulphurisation agent for the treatment of molten steel is a serious disadvantage in that it can lead to the undesirable phenomenon of hydrogen pick-up by the steel.

The pore-blocking effect utilised in the invention enables the tendency of the lime to absorb moisture to be greatly reduced and the use of silica or siliceous matter to achieve the pore-blocking is especially advantageous from this point of view. Surprisingly, sodium carbonate, which is known to have a substantial tendency to absorb moisture, is another pore-blocking additive that greatly reduces the tendency of the desulphurisation agent to absorb moisture. Calcium fluoride as the pore-blocking additive also serves greatly to reduce the tendency of the lime to absorb moisture.

A yet further advantage of the pore-blocking effect is that it renders the particles substantially more resistant during handling and transport to crumbling and attrition. Thus, the compressive and shear strength of the particles is increased. This advantage is valuable in that highly porous lime particles are very subject to damage during handling and thus, whilst a product as made may have the desired particle sizes, the proportion of fine matter in the product as used tends to be higher due to damage caused during transport and handling. The presence of a substantial proportion of fines in lime-containing desulphurisation agents for ferrous melts is undesirable in that it is liable to result in evolution of dust and wastage of the desulphurisation agent during use. Furthermore, an increase in the proportion of fines tends to make the material less free flowing and therefore less suitable for injection.

Whilst a low proportion of a pore-blocking additive such as silica, calcium fluoride or sodium carbonate may adequately block the pores for the purposes described, a higher total proportion of flux may be desired in the desulphurisation agent in order to promote rapid desulphurisation. Accordingly, if the pore-blocking additive is silica or siliceous material, it is preferred, in order not to reduce the basicity of the desulphurisation agent and yet to promote rapid desulphurisation, to use only sufficient silica or siliceous material to achieve the desired pore-blocking and to include additionally a non-acidic, non-siliceous flux such as calcium fluoride or sodium carbonate. In cases where the pore-blocking additive is itself a non-acidic, non-siliceous flux, sufficient is included to achieve not only the desired pore-blocking effect but also to provide a sufficient total proportion of flux in the composition. If a separate flux in addition to the pore-blocking additive is used, the limestone or lime and the pore-blocking additive and the separate flux are preferably all heated together during the pore-blocking process.

In general the desulphurisation agent preferably contains 5 to 60% by weight of non-acidic, non-siliceous flux. The amount of lime is preferably from 40 to 90% by weight with a minimum of at least 60% by weight being preferred if the agent is for treating steel. With amounts of lime less than 40% it is difficult to achieve a suitable composition with a sufficiently high basicity whilst amounts over 90% by weight generally preclude the inclusion of sufficient amounts of flux to enable the desulphurisation agent to effect rapid desulphurisation.

In the case of steel melts with their relatively high temperatures, smaller amounts of flux are generally needed than in the case of iron melts with their lower temperatures to obtain a product that can effect rapid desulphurisation. Sodium carbonate is a particularly suitable pore-blocking agent and flux in the case of iron melts because of its relatively low melting point.

Not only are the desulphurising agents very satisfactory for desulphurising ferrous melts by injection but also they are simple to manufacture and do not require unduly large amounts of energy for their manufacture. In general the pore-blocking effect can be achieved by use of temperatures in the range of 950° C. to 1400° C., which are also sufficient for any necessary calcination. In contrast, any technique requiring complete fusion of lime or a lime-containing mixture would generally need substantially higher temperatures and would therefore consume more energy. The heating needed to achieve the pore-blocking effect and any necessary calcination can be effected in a rotary shaft, rotating heart or tunnel kiln or in a fluidised bed furnace.

In making the desulphurisation agents it is preferred that all the materials heated together should have particle sizes not greater than 1 mm and preferably not less than 0.1 mm. If the particles have sizes greater than 1 mm, it is more difficult to ensure that the lime pores are adequately blocked. As a result of the heating some agglomeration of the particles takes place to give larger particles. It is preferred that in the final product the particles should have sizes not less than 0.1 mm and usually not greater than 1 mm and this can be achieved by crushing and screening. The fact that the pore-blocking effect increases the resistance of the lime-containing particles to crumbling and attrition helps in that it reduces the tendency of the crushing operation to give a substantial proportion of fines in addition to particles having sizes in the desired range.

If the material that is heated is a limestone containing a significant proportion of silica and no separate pore-blocking material is to be added before the heating, the initial particle size is less important and may be, for example, as high as 12 mm, although unduly large particles are to be avoided as they increase the time needed to effect the calcination and pore-blocking. However, in products made by use of this procedure, the particle sizes of the final products are preferably as indicated above.

The invention includes not only the desulphurisation method but also, for use in that method, a desulphurisation agent comprising lime-containing particles having a low tendency to absorb moisture, having smooth surfaces and having blocked pores formed by the solidification of molten inorganic matter in the pores in the lime. Preferred features of the desulphurisation agent are as described above and the described methods of making the desulphurisation agent form a further part of the invention. If desired the desulphurisation agent may contain additional ingredients, e.g. alumina to improve the rate of desulphurisation.

BRIEF DESCRIPTION OF THE DRAWING

The upper half of the attached drawing is a photographic representation magnified 10× of the product of Example 3 which follows, while the lower half of the attached drawing is a photographic representation magnified 10× of the product of Example 3 which has not been subjected to heat treatment.

EXAMPLES

Calcium carbonate was mixed with sodium carbonate (Example 1), calcium fluoride (Example 2) and calcium fluoride and silica (Example 3) in proportions corresponding to the lime, sodium carbonate, calcium fluoride and silica percentages by weight shown in the Table below. The materials used all had particle sizes in the range 0.1 to 1 mm and the mixtures were separately heated in a kiln at the temperatures shown in the Table.

| Ingredient | Example 1 % by weight | Example 2 % by weight | Example 3 % by weight |
|---|---|---|---|
| lime | 90 | 85 | 84 |
| sodium carbonate | 10 | | |
| calcium fluoride | | 15 | 14 |
| silica | | | 2 |
| kiln temperature | 1000° C. | 1200° C. | 1200° C. |

After the mixtures had been heated each was removed from the kiln and crushed and screened to give particle sizes in the range 0.1 mm to 1 mm. The product of Example 1 is an effective desulphurising agent for injecting into molten iron whilst the products of Example 2 and 3 are effective desulphurisation agents for injecting into molten steel.

All the products had excellent free flowing properties and the surfaces of the particles were smooth as revealed by microscopic examination at a low magnification (X10). Microscopic examination at a higher magnification revealed that the pores of the lime particles were blocked and the appearance of the particles contrasted sharply with lime particles obtained by calcining limestone by itself. Further tests showed that all the products had a very low tendency to absorb moisture as compared with lime made by calcining limestone by itself. Likewise, tests showed that the products of the Examples had less tendency to crumble and suffer attrition.

The product of Example 3 was photographed at a magnification of X10 and the photograph is the upper half of the attached photograph. The lower half of the attached photograph is a photograph at the same magnification of a product containing the same ingredients in the same proportions but which has not been subjected to the heat treatment used to form the product of Example 3. As can be seen from the photographs, the particles of the product of Example 3 have smooth surfaces and little tendency to agglomerate whereas the particles of the other product have rough surfaces and a marked tendency to agglomerate.

We claim:

1. A method of desulphurising a ferrous melt which comprises injecting into the melt a desulphurisation agent comprising lime-containing particles having pores, which pores are blocked by the solidification of molten inorganic matter distinct from lime in the pores of the lime, the surfaces of the particles thereby being rendered smooth and having a low tendency to absorb moisture thereby being imparted to the particles.

2. A method according to claim 1 in which the desulphurisation agent is injected at a rate of at least 30 kg/minute.

3. A method according to claim 1 in which the particles have sizes in the range of 0.1 to 1 mm.

4. A method according to claim 1 in which the solidified matter in the pores of the lime comprises at least one material selected from the group consisting of sodium carbonate, calcium fluoride and siliceous matter.

5. A method of making a desulphurisation agent for a ferrous melt which comprises the steps of: calcining limestone with added inorganic matter distinct from lime that yields at least partly fused matter at the calcination temperature and in the presence of lime, formed by calcination of limestone; and cooling the resultant product to cause blocking of pores in the lime by solidification of the fused matter, so that the particles are rendered smooth and have a low tendency to absorb moisture.

6. A method according to claim 5 in which the added inorganic matter comprises at least one material selected from the group consisting of sodium carbonate, calcium fluoride, silica and other siliceous materials.

7. A method according to claim 6 in which the added inorganic matter comprises sodium carbonate in an amount to provide 1 to 20% by weight of the desulphurisation agent.

8. A method according to claim 6 in which the added inorganic matter comprises silica or siliceous matter in an amount to provide 1.6 to 5 parts by weight per 100 parts by weight of the lime produced by calcination of the limestone.

9. A method according to claim 6 in which the added inorganic matter comprises calcium fluoride in an amount to provide 1 to 30% by weight of the desulphurisation agent.

10. A method according to claim 5 in which the materials heated together have particle sizes in the range of 0.1 to 1 mm.

11. A method according to claim 5 in which the product is screened and crushed to give particles having sizes in the range of 0.1 to 1 mm.

12. A desulphurisation agent, for a ferrous melt, comprising lime-containing particles having pores blocked by the solidification of molten siliceous matter in the pores of the lime, the particles being smooth.

13. A desulphurisation agent according to claim 12 in which the particles have sizes in the range of 0.1 to 1 mm.

14. A desulphurisation agent according to claim 12 in which 1.6 to 5 parts by weight of siliceous matter are present per 100 parts by weight of the lime.

* * * * *